US011040356B2

(12) United States Patent
Song

(10) Patent No.: US 11,040,356 B2
(45) Date of Patent: Jun. 22, 2021

(54) SHOWER HEAD STRUCTURE

(71) Applicants: Zhejiang Petalent Pet Supplies Co., Ltd., Jinhua (CN); WENZHOU WANKANG PET PRODUCTS CO., LTD., Wenzhou (CN)

(72) Inventor: Jinyue Song, Wenzhou (CN)

(73) Assignees: Zhejiang Petalent Pet Supplies Co., Ltd., Jinhua (CN); WENZHOU WANKANG PET PRODUCTS CO., LTD., Wenzhou (CN)

( * ) Notice: Subject to any disclaimer, the term of this patent is extended or adjusted under 35 U.S.C. 154(b) by 220 days.

(21) Appl. No.: 16/492,109

(22) PCT Filed: Dec. 28, 2017

(86) PCT No.: PCT/CN2017/119398
§ 371 (c)(1),
(2) Date: Sep. 7, 2019

(87) PCT Pub. No.: WO2018/126983
PCT Pub. Date: Jul. 12, 2018

(65) Prior Publication Data

US 2020/0338574 A1 Oct. 29, 2020

(30) Foreign Application Priority Data

Jan. 5, 2017 (CN) ..... 201720010761.4

(51) Int. Cl.
*B05B 1/18* (2006.01)
*B05B 1/16* (2006.01)

(52) U.S. Cl.
CPC ..... *B05B 1/185* (2013.01); *B05B 1/1636* (2013.01)

(58) Field of Classification Search
CPC ..... B05B 1/1636; B05B 1/1681; B05B 1/18; B05B 1/185; B05B 15/63; A46B 11/06; A46B 11/063; A61H 7/003
See application file for complete search history.

(56) References Cited

U.S. PATENT DOCUMENTS 5,109,553 A * 5/1992 Kishimoto ..... A46B 11/06 4/518
5,228,625 A * 7/1993 Grassberger ..... B05B 15/528 239/558

(Continued)

FOREIGN PATENT DOCUMENTS

CH 388865 A 2/1965
CN 2680358 Y 2/2005

(Continued)

OTHER PUBLICATIONS

Internation Search Report of PCT/CN2017/119398, dated Apr. 4, 2018.

*Primary Examiner* — Darren W Gorman
(74) *Attorney, Agent, or Firm* — True Shepherd LLC; Andrew C. Cheng

(57) ABSTRACT

A shower head structure comprises a handle with a passage. A head portion is arranged at one end of the handle, and the head portion is internally provided with an accommodating cavity. The accommodating cavity is in communication with the passage. First water through holes and bumps made of elastic materials are arranged on one face of the head portion. The first water through holes are in communication with the accommodating cavity. A reinforcing plate is arranged on the face where the bumps are arranged of the head portion. The reinforcing plate is provided with spray holes and reinforcing holes for the bumps to pass through. Side walls of the reinforcing holes are closely attached to (Continued)

roots of the bumps. The spray holes are in communication with the first water through holes.

10 Claims, 10 Drawing Sheets

(56) References Cited

U.S. PATENT DOCUMENTS

| | | | | |
|---|---|---|---|---|
| 2013/0092752 | A1* | 4/2013 | Schumacher | B05B 1/3013 239/154 |
| 2015/0367355 | A1* | 12/2015 | Komaki | B05B 1/185 239/381 |

FOREIGN PATENT DOCUMENTS

| | | | |
|---|---|---|---|
| CN | 201214076 | Y | 4/2009 |
| CN | 201454719 | U | 5/2010 |
| CN | 102019239 | A | 4/2011 |
| CN | 201900055 | U | 7/2011 |
| CN | 201988466 | U | 9/2011 |
| CN | 103008128 | A | 4/2013 |
| CN | 206382134 | U | 8/2017 |
| FR | 2723302 | A1 | 2/1996 |
| WO | 9218250 | A1 | 10/1992 |

* cited by examiner

SHOWER HEAD STRUCTURE

TECHNICAL FIELD

The disclosure relates to a shower head, in particular to a shower head structure.

BACKGROUND OF THE PRESENT INVENTION

A shower is a sprayer-shaped spray device that sprays cold water or hot water, and is widely used in household appliances such as toilets, sinks and bathtubs, as well as spray throwers, waterfalls, water softeners and bathtubs.

The handle of the shower is connected to the end part of a hose connected with a water supply pipe. One end of the handle is provided with a head portion that forms a plurality of spray ports thereon, and is capable of dividing the water into a plurality of sprays.

SUMMARY OF PRESENT INVENTION

Technical Problems

A shower head in which pluralities of elastic bumps are spaced on a surface of the head portion has appeared now. When a user body is cleaned, the elastic bumps come into contact with the user body, massage the user body or remove foreign matter attached to the user body. However, the elastic bumps am soft in texture, are directly arranged on the surface of the head portion, and are easily bent during cleaning, causing that the bumps cannot sufficiently come into contact with the body and the cleaning effect is poor.

Technical Solution

In view of the defects in the prior art, the purpose of the disclosure is to provide a shower head structure to strengthen the structure of the bumps.

To achieve the above purpose, the disclosure provides the following technical solution: a shower head structure comprises a handle with a passage, a head portion is arranged at one end of the handle, and the head portion is internally provided with an accommodating cavity; the accommodating cavity is in communication with the passage; first water through holes and bumps made of elastic materials are arranged on a surface of the head portion; the first water through holes are in communication with the accommodating cavity; a reinforcing plate is arranged on the surface of the head portion on which the bumps are arranged; the reinforcing plate is provided with spray holes and reinforcing holes through which the bumps pass; side walls of the reinforcing holes are closely attached to root portions of the bumps; and the spray holes are in communication with the first water through holes.

As a further improvement of the disclosure, the head portion is provided with an anti-splash shell for preventing water from splashing on a user; the anti-splash shell comprises a bottom plate and a side plate surrounding the edge of the bottom plate; a lower end surface of the bottom plate is connected with the head portion; the bumps are arranged on an upper end surface of the bottom plate; the reinforcing plate is connected to the upper end surface of the bottom plate; the bottom plate is provided with second water through holes; and the second water through holes are in communication with the first water through holes and the spray holes.

As a further improvement of the disclosure, the side plate is provided with drainage holes or drainage pipes.

As a further improvement of the disclosure, the bottom plate, the side plate and the bumps are integrally formed; and the outer side surface of the reinforcing plate is attached to the inner side surface of the side plate.

As a further improvement of the disclosure, a surface of the head portion opposite to the bumps is provided with a sheet for holding by fingers; one end of the sheet opposite to the bumps is provided with a baffle plate; the sheet is matched with the baffle plate; and clamping grooves through which the fingers pass are formed on both sides of the sheet.

As a further improvement of the disclosure, an opening and closing valve for opening and closing the first water through holes is arranged in the head portion; the opening and closing valve comprises a switch block, a rotating block, a spring and a steel ball; one side of the head portion is provided with an installing hole; the installing hole is in communication with the accommodating cavity; the rotating block is arranged in the accommodating cavity; the switch block is arranged in the installing hole, extends into the accommodating cavity, and is in transmission connection with the rotating block in the accommodating cavity to drive the rotating block to rotate; one end of the rotating block opposite to the switch block is provided with an installing groove; the spring is arranged in the installing groove; the steel ball is arranged at one end of the spring opposite to the installing groove; the spring pushes the steel ball to make the steel ball abutted against the lower end surface of the bottom plate; and when the switch block rotates, the rotating block rotates to drive the steel ball to move, so that the steel ball opens or closes the first water through holes.

As a further improvement of the disclosure, the rotating block is provided with a transmission block; the transmission block has a waist shape, a triangle shape, a rectangle shape or a diamond shape; the switch block is provided with a transmission hole adapted to the transmission block; and the transmission block is embedded into the transmission hole, so that the switch block drives the rotating block to rotate.

As a further improvement of the disclosure, the surface of the head portion in which the first water through holes are arranged is provided with an accommodating groove; the accommodating groove is in communication with the first water through holes; a plugging block is arranged in the accommodating groove; the plugging block is closely attached to the accommodating groove to release the communication of the first water through holes and the accommodating cavity; the plugging block is provided with third water through holes; the third water through holes are in communication with the accommodating cavity and the spray holes; and the steel ball is abutted against the plugging block to open or close the third water through holes.

As a further improvement of the disclosure, an end surface of the side plate opposite to the head portion is provided with a plurality of elastic blocks for contacting with a human body, and the elastic blocks are evenly distributed on the end surface.

As a further improvement of the disclosure, the inner side surface of the head portion extends inwardly and is provided with a guiding block; the rotating block is provided with an arc-shaped sliding groove; the guiding block is inserted into the sliding groove; and the guiding block is capable of sliding in the sliding groove.

Beneficial Effects

The disclosure has the following beneficial effects: the reinforcing plate is arranged on the surface of the head portion on which the bumps are arranged; and the bumps pass through the reinforcing holes on the reinforcing plate. The side walls of the reinforcing holes are closely attached to the root portions of the bumps to support the bumps from the side surface, thereby reducing force arms of the bumps and improving the structural strength of the bumps, so that the bumps are not prone to bending when coming into contact with a human body, thereby better cleaning the surface of the body and better massaging the body.

DETAILED DESCRIPTION OF PREFERRED EMBODIMENTS

Figure 1:
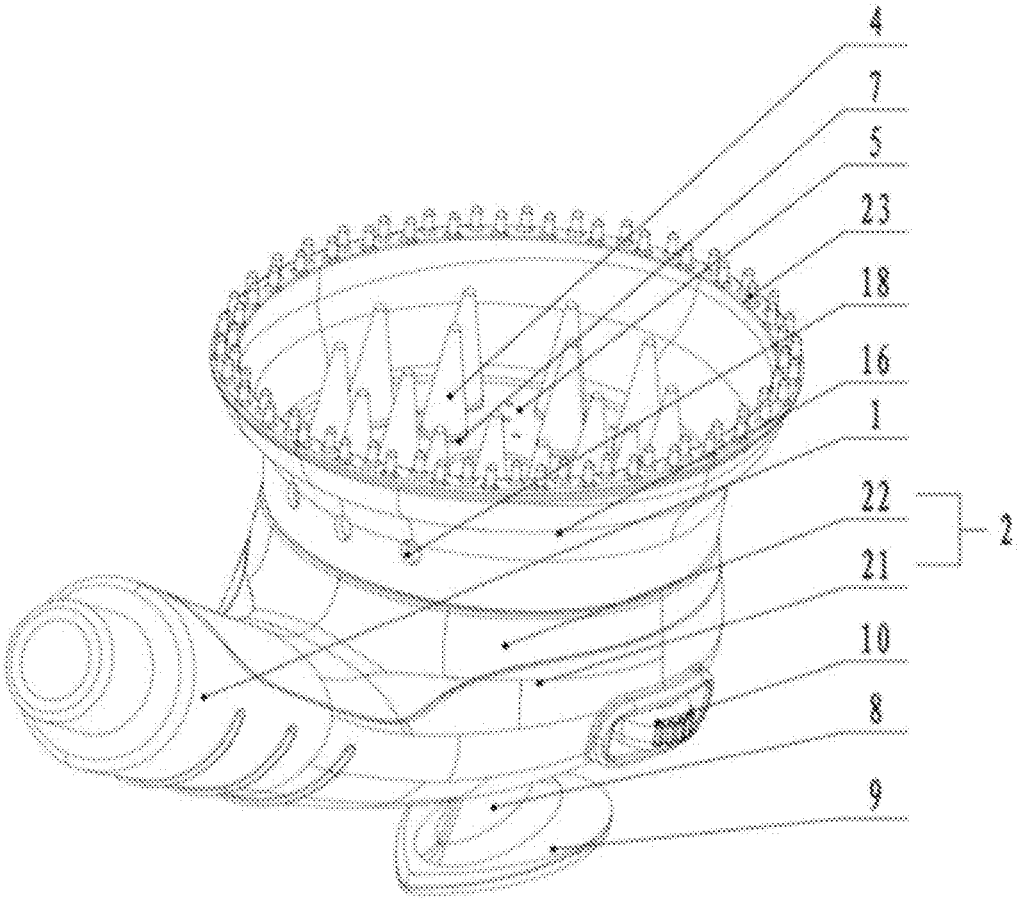
FIG. 1 is a structural diagram of a shower head structure according to the disclosure.

The disclosure is further described in detail below in combination with embodiments shown in the drawings.

Figure 2:
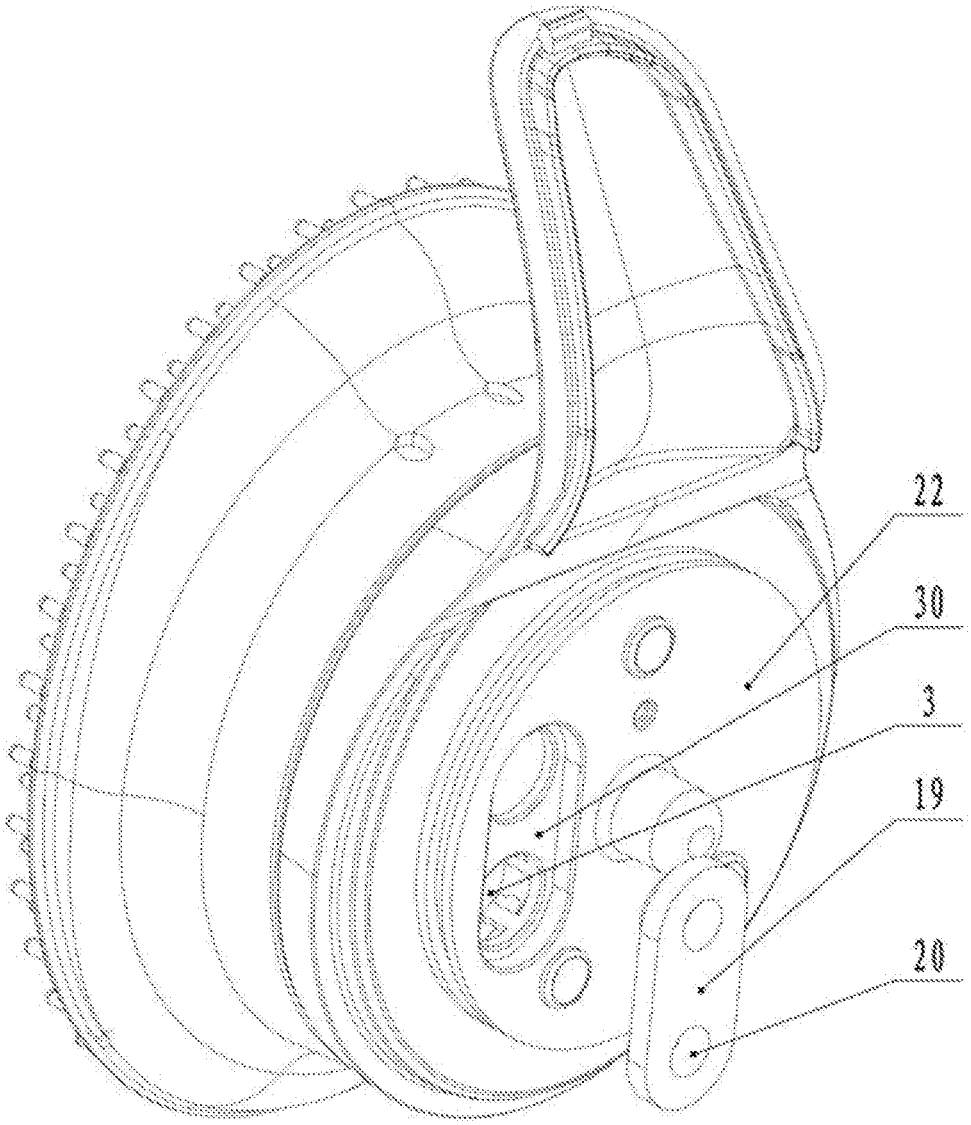
FIG. 2 is a structural diagram of a head portion of the shower head structure according to the disclosure.
Figure 3:
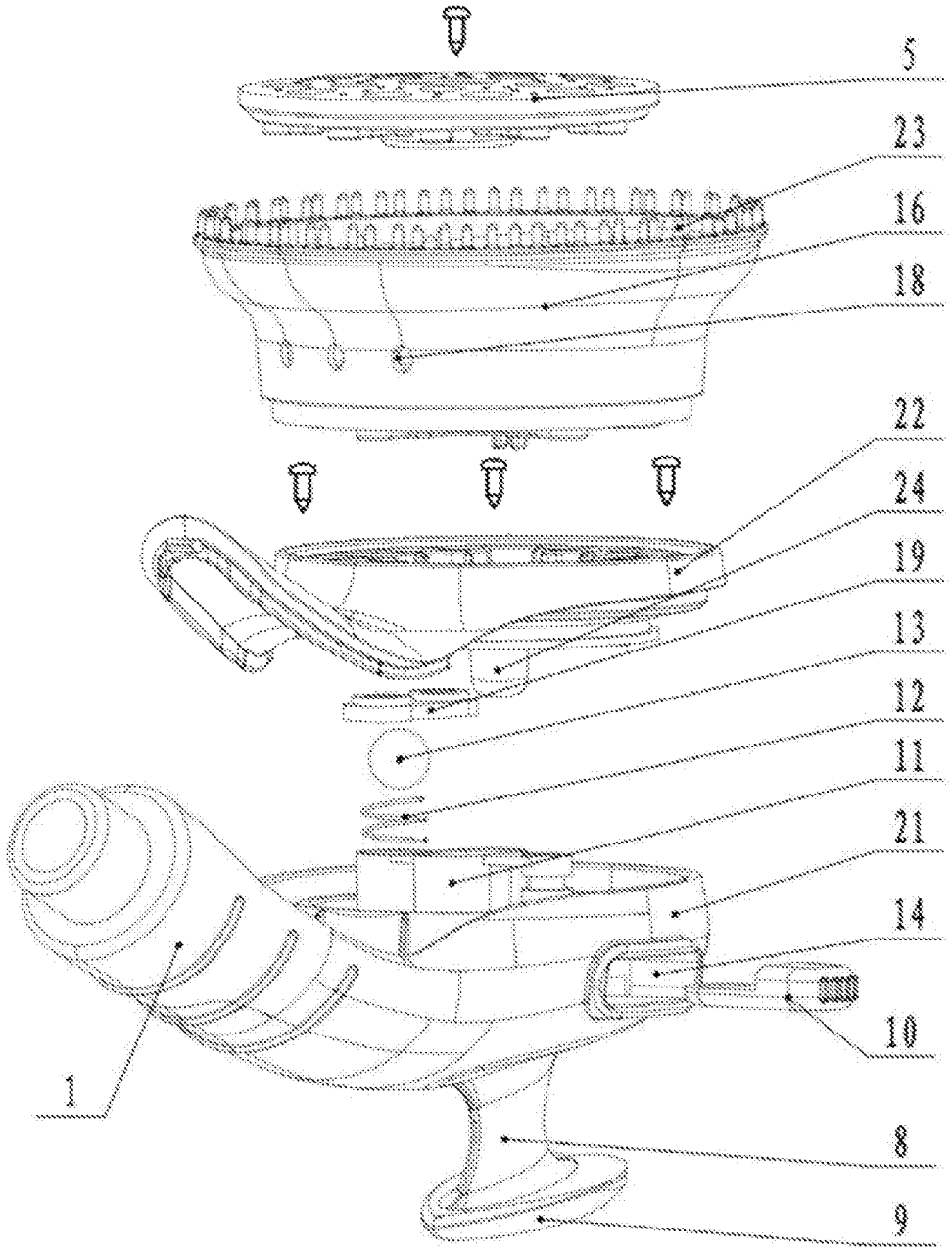
FIG. 3 is an exploded structural diagram of the shower head structure according to the disclosure.
Figure 4:
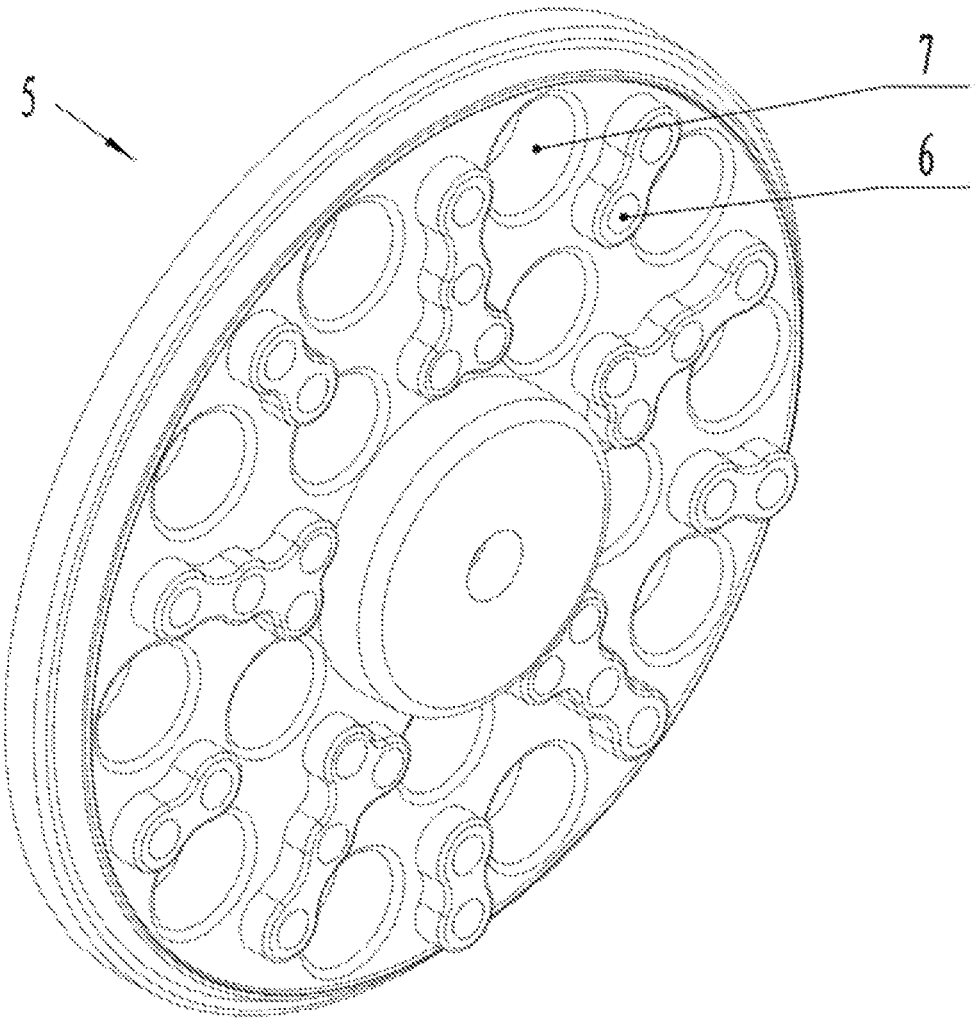
FIG. 4 is a structural diagram of a reinforcing plate.
Figure 5:
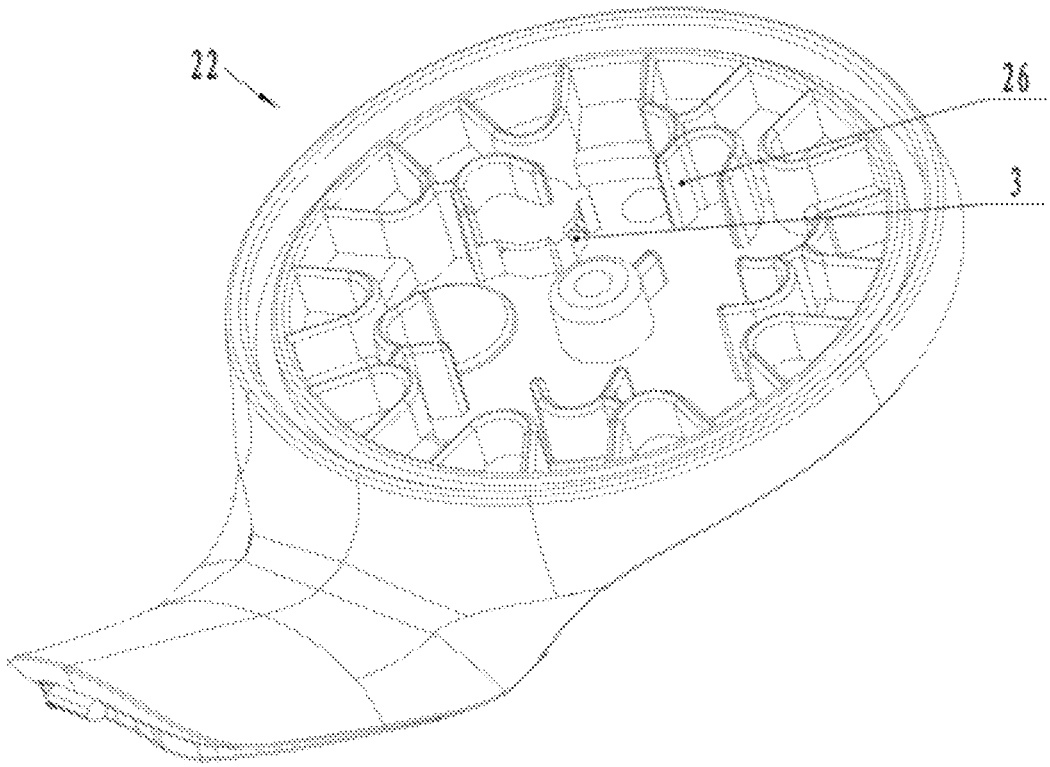
FIG. 5 is a structural diagram of a closing plate according to the disclosure.
Figure 6:
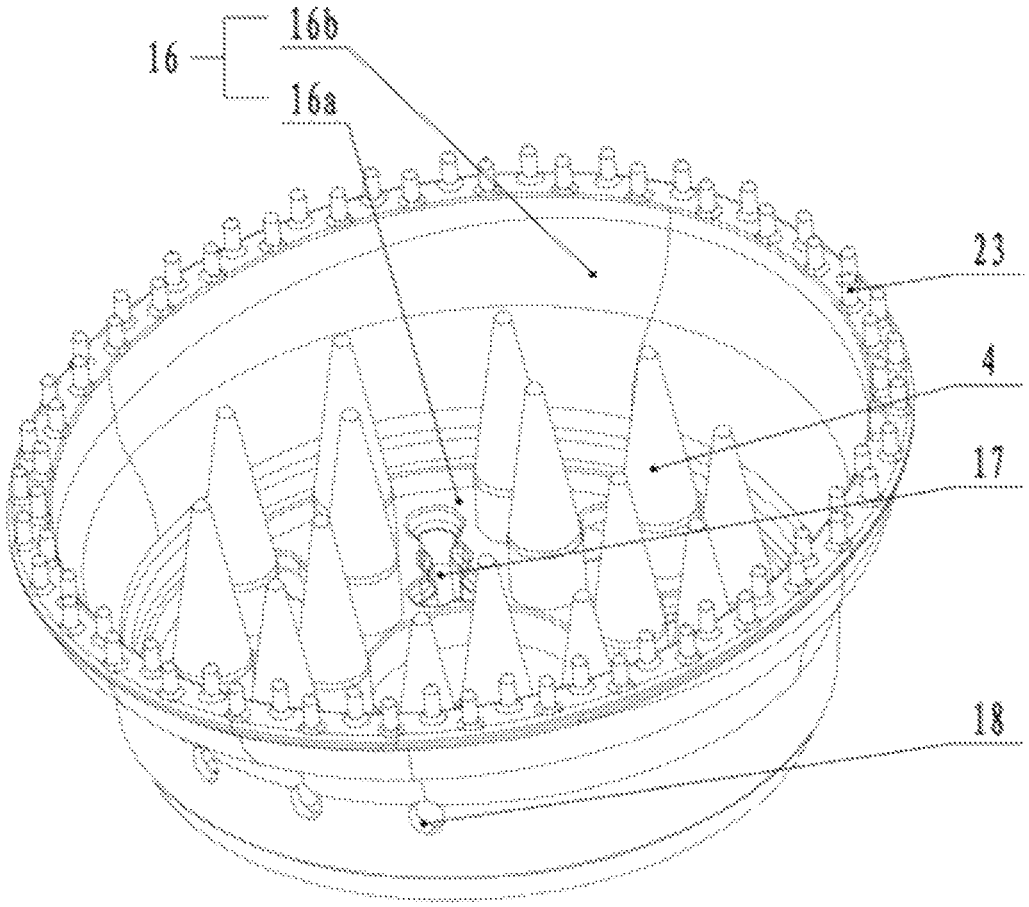
FIG. 6 is a structural diagram of an anti-splash shell according to the disclosure.
Figure 7:
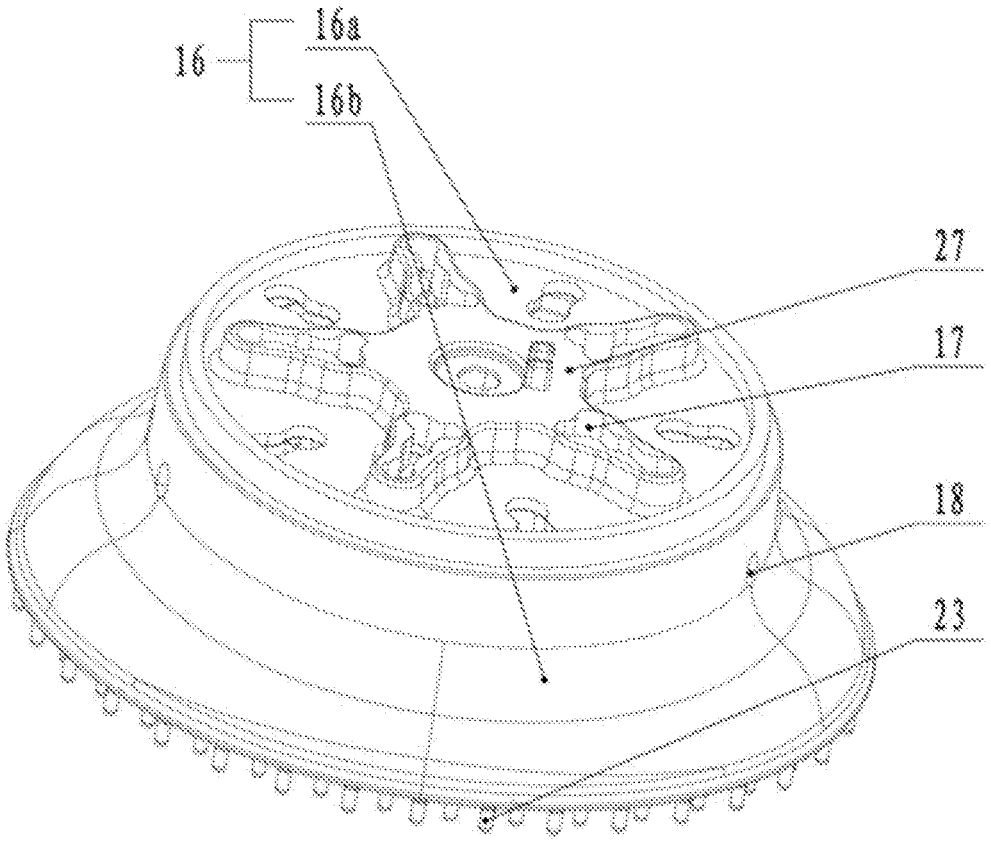
FIG. 7 is another structural diagram of the anti-splash shell according to the disclosure.
Figure 8:
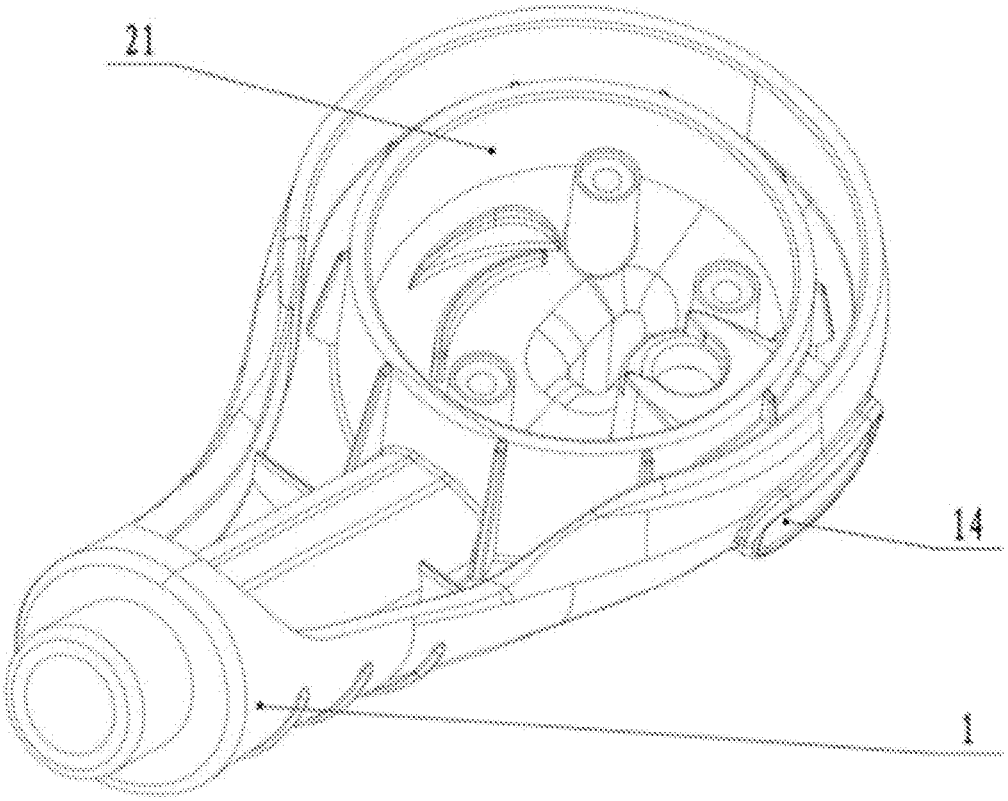
FIG. 8 is a structural diagram of an accommodating shell according to the disclosure.
Figure 9:
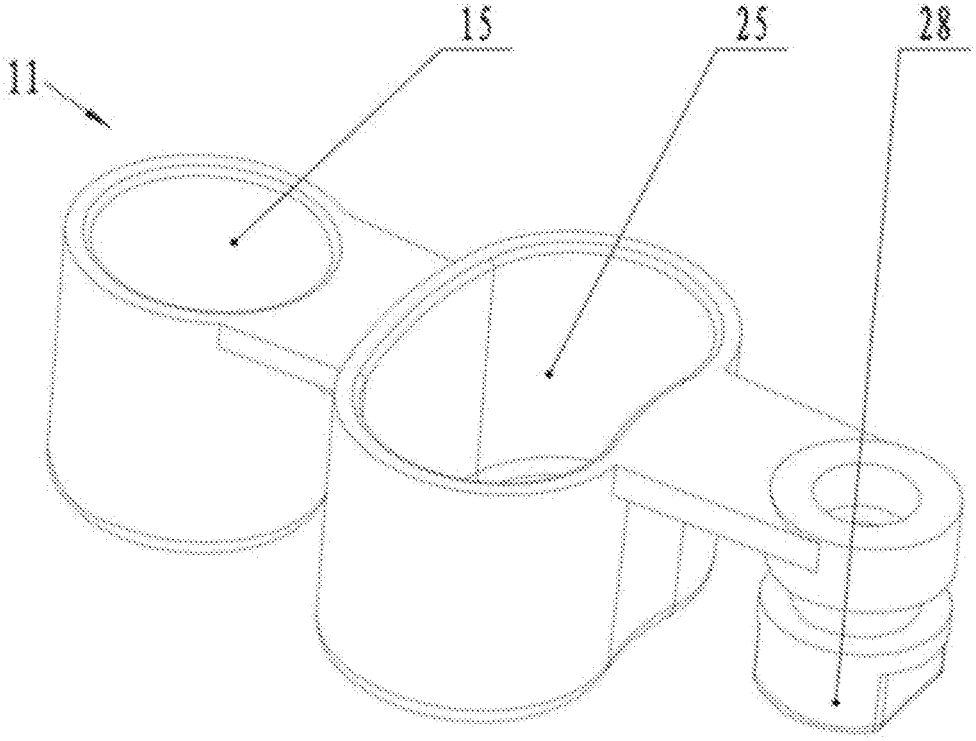
FIG. 9 is a structural diagram of a rotating block according to the disclosure.
Figure 10:
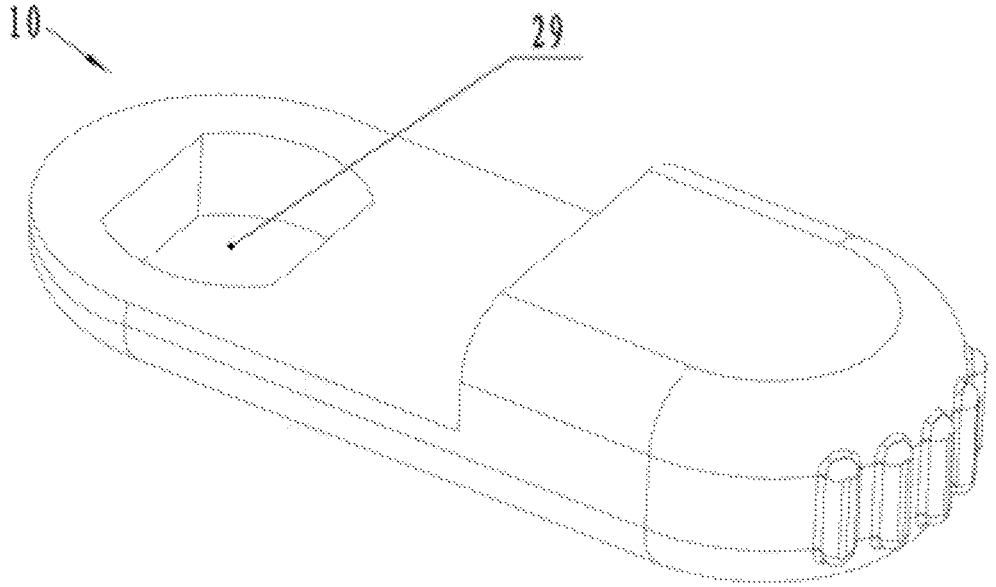
FIG. 10 is a structural diagram of a switch block according to the disclosure.

As shown in FIG. 1 to FIG. 10, a shower head structure in the present embodiment comprises a handle 1 with a passage. A head portion 2 is arranged at one end of the handle 1. The head portion 2 is formed by assembling a closing plate 22 and an accommodating shell 21. The handle 1 and the accommodating shell 21 are integrally formed. The head portion 2 is internally provided with an accommodating cavity. The accommodating cavity is in communication with the passage. First water through holes 3 and bumps 4 made of elastic materials are arranged on a surface of the head portion 2. The first water through holes 3 are in communication with the accommodating cavity. A reinforcing plate 5 is arranged on the surface of the head portion 2 on which the bumps 4 are arranged; the reinforcing plate 5 is provided with spray holes 6 and reinforcing holes 7 through which the bumps 4 pass; side walls of the reinforcing holes 7 are closely attached to root portions of the bumps 4; and the spray holes 6 are in communication with the first water through holes 3. The handle 1 is connected with a pipeline to connect water into the accommodating cavity. The water flows in the accommodating cavity, flows out from the first water through holes 3, and then is sprayed from the spray holes 6 to clean the surface of the body. The bumps 4 are in contact with the body during cleaning and move on the surface of the body to clean the body or massage the body. The side walls of the reinforcing holes 7 are closely attached to the root portions of the bumps 4 to support the bumps 4 from a side surface, thereby reducing force arms of the bumps 4 and improving the structural strength of the bumps 4, so that the bumps 4 are not prone to bending when coming into contact with a human body, thereby better cleaning the surface of the body and better massaging the body.

As a specific embodiment of improvement, the head portion 2 is provided with an anti-splash shell 16 for preventing the water from splashing on a user; the anti-splash shell 16 comprises a bottom plate 16*a* and a side plate 16*b* surrounding the edge of the bottom plate 16*a*; a lower end surface of the bottom plate 16*a* is connected with the head portion 2; the bumps 4 are arranged on an upper end surface of the bottom plate 16*a*; the reinforcing plate 5 is connected to the upper end surface of the bottom plate 16*a*; the bottom plate 16*a* is provided with second water through holes 17; and the second water through holes 17 are in communication with the first water through holes 3 and the spray holes 6. During cleaning, a water flow splashes when sprayed onto the body, and the anti-splash shell 16 is attached to the surface of the body. The side plate 16*b* blocks the splashed water, and the anti-splash shell 16 can prevent the water from splashing on the user, to prevent the water from wetting a place that does not need to be cleaned. The bottom plate 16*a* is arranged. The side plate 16*b* is arranged on the bottom plate 16*a*. The bottom plate 16*a* increases the contact area of the anti-splash shell 16 with the head portion 2, facilitates the installation of the anti-splash shell 16 onto the head portion 2, and increases the stress area, so that the connection between the anti-splash shell 16 and the head portion 2 is firmer.

As a specific embodiment of improvement, the side plate 16*b* is provided with drainage holes 18 or drainage pipes. After the water is limited into the anti-splash shell 16, the water flows out from the contact portion of the anti-splash shell 16 with the body and flows to other places of the body. The drainage holes 18 or the drainage pipes are arranged to guide the water to flow out from the drainage pipes or the drainage holes 18 to prevent the water from flowing to other places.

As a specific embodiment of improvement, the bottom plate 16*a*, the side plate 16*b* and the bumps 4 are integrally formed, so that the bottom plate 16*a*, the side plate 16*b* and the bumps 4 are combined together more firmly, to prolong the service life. Relative to the separate arrangement of the bottom plate 16*a*, the side plate 16*b* and the bumps 4, the present embodiment adopts integral arrangement and integral formation without the need of separate assembly, so that the manufacturing process is simpler and the structure is firmer. The outer side surface of the reinforcing plate 5 is attached to the inner side surface of the side plate 16*b* to support the side plate 16*b* from a side surface, thereby improving the strength of the side plate 16*b* and reducing the deformation of the side plate 16*b* under stress. Excessive deformation is easy to accelerate the aging of the material. The above arrangement can prolong the service life of the side plate 16*b*.

As a specific embodiment of improvement, the surface of the head portion 2 opposite to the bumps 4 is provided with a sheet 8 for holding by fingers; one end of the sheet 8 opposite to the bumps 4 is provided with a baffle plate 9; the sheet 8 is matched with the baffle plate 9; and clamping grooves through which the fingers pass are formed on both sides of the sheet 8. During cleaning, an operator enables a finger to pass through the clamping grooves to clamp the sheet 8. The baffle plate 9 and the head portion 2 are positioned on both sides of the finger to fix the shower head to the hand more firmly to prevent the shower head from slipping off.

As a specific embodiment of improvement, an opening and closing valve for opening and closing the first water through holes 3 is arranged in the head portion 2; the opening and closing valve comprises a switch block 10, a rotating block 11, a spring 12 and a steel ball 13; one side of the head portion 2 is provided with an installing hole 14; the installing hole 14 is in communication with the accommodating cavity; the rotating block 11 is arranged in the accommodating cavity; the switch block 10 is arranged in the installing hole 14, extends into the accommodating cavity, and is in transmission connection with the rotating block 11 in the accommodating cavity to drive the rotating block 11 to rotate; one end of the rotating block 11 opposite to the switch block 10 is provided with an installing groove 15; the spring 12 is arranged in the installing groove 15; the steel ball 13 is arranged at one end of the spring 12 opposite to the installing groove 15; the spring 12 pushes the steel ball 13 to make the steel ball 13 abutted against the lower end surface of the bottom plate 16*a*; and when the switch block 10 rotates, the rotating block 11 rotates to drive the steel ball 13 to move, so that the steel ball 13 opens or closes the first water through holes 3. When the shower head needs to be closed, the switch block 10 is toggled to drive the rotating block 11 to rotate; and the side wall of the installing groove 15 pushes the steel ball 13 to drive the steel ball 13 to move. When the steel ball 13 reaches the first water through hole 3, the spring 12 pushes the steel ball 13 toward the first water through hole 3, and the steel ball 13 blocks the first water through hole 3; and the water is retained in the accommodating cavity, and does not flow out from the first water through hole 3, so that the water is not sprayed from the spray hole 6. When the shower head is opened, the steel ball 13 is moved out of the first water through hole 3 through similar operation. Through the above arrangement, when the shower head is held by a single hand, the switch block 10 can be toggled with a thumb, which is convenient to operate.

As a specific embodiment of improvement, the rotating block 11 is provided with a transmission block 28; the transmission block 28 has a waist shape, a triangle shape, a rectangle shape or a diamond shape; the switch block 10 is provided with a transmission hole 29 adapted to the transmission block 28; and the transmission block 28 is embedded into the transmission hole 29, so that the switch block 10 drives the rotating block 11 to rotate. The transmission block 28 can be a non-circular structure such as a rectangle, a triangle and a diamond. The transmission block 28 is embedded into the transmission hole 29 to keep the switch block 10 and the rotating block 11 linked in the original state, thereby realizing the function of the switch block 10 to drive the rotating block 11. The transmission is stable, the disassembly and the assembly are convenient, and the manufacturing is convenient.

As a specific embodiment of improvement, the surface of the head portion 2 in which the first water through holes 3 are arranged is provided with an accommodating groove 30; the accommodating groove 30 is in communication with the first water through holes 3; a plugging block 19 is arranged in the accommodating groove 30; the plugging block 19 is closely attached to the accommodating groove 30 to release the communication of the first water through holes 3 and the accommodating cavity; the plugging block 19 is provided with third water through holes 20; the third water through holes 20 are in communication with the accommodating cavity and the spray holes; and the steel ball 13 is abutted against the plugging block 19 to open or close the third water through holes 20. The head portion 2 is generally made of hard material and is easy to be worn when matched with the steel ball 13, resulting in water leakage of the first water through holes 3. The plugging block 19 is arranged below the first water through hole 3. The plugging block 19 is generally made of elastic material such as rubber, and has better sealing performance. The plugging block 19 is not easy to be worn when matched with the steel ball 13, so as to prevent water leakage due to wear.

As a specific embodiment of improvement, an end surface of the side plate 16*b* opposite to the head portion 2 is provided with a plurality of elastic blocks 23 for contacting with a human body, and the elastic blocks 23 are evenly distributed on the end surface. When the shower head is used, the elastic blocks 23 are in contact with the body to clean or massage the body.

As a specific embodiment of improvement, the inner side surface of the head portion 2 extends inwardly and is provided with a guiding block 24; the rotating block 11 is provided with an arc-shaped sliding groove 25; the guiding block 24 is inserted into the sliding groove 25; and the guiding block 24 is capable of sliding in the sliding groove 25. The guiding block 24 guides the direction of rotation of the rotating block 11. The rotating block 11 has more stress points during the rotation, so as to rotate more smoothly.

As a specific embodiment of improvement, the surface of the head portion 2 in which the spray holes 6 are arranged is provided with a positioning groove 26. The lower end surface of the bottom plate 16*a* is provided with a positioning block 27. The positioning block 27 is inserted into the positioning groove 26 for preventing the anti-splash shell 16 from rotating relative to the closing plate 22. The closing plate 22 and the anti-splash plate 16 are positioned through the positioning block 27 and the positioning groove 26. The second water through hole 17 and the spray hole 6 are ensured to be in communication during the assembly, and the anti-splash shell 16 is convenient to be installed on the closing plate 22.

The above only describes preferred embodiments of the disclosure. The protection scope of the disclosure is not limited to the above embodiments. All technical solutions under the concept of the disclosure belong to the protection scope of the disclosure. It should be noted that, for those ordinary skilled in the art, several improvements and modifications made without departing from the principles of the disclosure shall also be considered to be within the protection scope of the disclosure.

I claim:

1. A shower head structure, comprising a handle (1) with a passage, wherein a head portion (2) is arranged at one end of the handle (1), and the head portion (2) is internally provided with an accommodating cavity; the accommodating cavity is in communication with the passage; first water through holes (3) and humps (4) made of elastic materials are arranged on a surface of the head portion (2); the first water through holes (3) are in communication with the accommodating cavity, a reinforcing plate (5) is arranged on the surface of the head portion (2) on which the bumps (4) are arranged; the reinforcing plate (5) is provided with spray holes (6) and reinforcing holes (7) through which the bumps (4) pass; side walls of the reinforcing holes (7) are closely attached to, root portions of the bumps (4); and the spray holes (6) are in communication with the first water through holes (3).

2. The shower head structure according to claim 1, wherein the head portion (2) is provided with an anti-splash shell (16) for preventing water from splashing on a user, the anti-splash shell (16) comprises a bottom plate (16*a*) and a side plate (16*b*) surrounding an edge of the bottom plate (16*a*); a lower end surface of the bottom plate (16*a*) is connected with the head portion (2); the bumps (4) are arranged on an upper end surface of the bottom plate (16*a*); the reinforcing plate (5) is connected to the upper end surface of the bottom plate (16*a*); the bottom plate (16*a*) is provided with second water through holes (17); and the second water through holes (17) are in communication with the first water through holes (3) and the spray holes (6).

3. The shower head structure according to claim 2, wherein the side plate (16*b*) is provided with drainage holes (18) or drainage pipes.

4. The shower head structure according to claim 2, wherein the bottom plate (16*a*), the side plate (16*b*) and the bumps (4) are integrally formed; and an outer side surface of the reinforcing plate (5) is attached to an inner side surface of the side plate (16*b*).

5. The shower head structure according to claim 1, wherein a surface of the head portion (2) opposite to the bumps (4) is provided with a sheet (8) for holding by fingers; one end of the sheet (8) opposite to the bumps (4) is provided with a baffle plate (9); the sheet (8) is matched with the baffle plate (9); and clamping grooves through which the fingers pass are formed on both sides of the sheet (8).

6. The shower head structure according to claim 2, wherein an opening, and closing valve for opening and closing the first water through holes (3) is arranged in the head portion the opening and closing valve comprises switch block (10), a rotating block (11), a spring (12) and a steel ball (13); one side of the head portion (2) provided with an installing hole (14); the installing hole (14) is in communication with the accommodating cavity; the rotating block (11) is arranged in the accommodating cavity; the switch block (10) is arranged in the installing hole (14), extends into the accommodating cavity, and is in transmission connection with the rotating block (11) in the accommodating cavity to drive the rotating block (11) to rotate; one end of the rotating block (11) opposite to the switch block (10) is provided with an installing groove (15); the spring (12) is arranged in the installing groove (15); the steel ball (13) is arranged at ore end of the spring (12) opposite to the installing groove (15); the spring (12) pushes the steel hall (13) to make the steel ball (13) abutted against the lower end surface of the bottom plate (16*a*); and when the switch block (10) rotates, the rotating block (11) rotates to drive the steel ball (13) to move, so that the steel ball (13) opens or closes the first water through holes (3).

7. The shower head structure according to claim 6, wherein the rotating block (11) is provided with a transmission block (28); the transmission block (28) has a waist shape, a triangle shape, a rectangle shape or a diamond shape; the switch block (10) is provided with a transmission hole (29) adapted to the transmission block (28); and the transmission block (28) is embedded into the transmission hole (29), so that the switch block (10) drives the rotating block (11) to rotate.

8. The shower head structure according to claim 6, wherein the surface of the head portion (2) on which the first water through holes (3) are arranged is provided with an accommodating groove (30); the accommodating groove (30) is in communication with the first water through holes (3); a plugging block (19) is arranged in the accommodating groove (30); the plugging block (19) is closely attached to the accommodating groove (30) to release the communication of the first water through holes (3) and the accommodating cavity; the plugging block (19) is provided with third water through holes (20); the third water through holes (20) are in communication with the accommodating cavity and the spray holes; and the steel ball (13) is abutted against the plugging block (19) to open or close the third water through holes (20).

9. The shower head structure according to claim 2, wherein an end surface of the side plate (16*b*) opposite to the head portion (2) is provided with a plurality of elastic blocks (23) for contacting with a human body, and the elastic blocks (23) are evenly distributed on the end surface.

10. The shower head structure according to claim 6, wherein an inner side surface of the head portion (2) extends inwardly and is provided with a guiding block (24); the rotating block (11) is provided with an arc-shaped sliding groove (25); the guiding block (24) is inserted into the sliding groove (25); and the guiding block (24) is capable of sliding in the sliding groove (25).

* * * * *